455-506 AU 263 EX
5/22/84 XR 4,450,434

United States Patent [19]
Nielsen et al.
[11] 4,450,434
[45] May 22, 1984

[54] APPARATUS FOR DETERMINING BREAK LOCATIONS IN FENCING

[75] Inventors: Paul H. Nielsen, Mahomet; Ray G. McCormack, St. Joseph, both of Ill.

[73] Assignee: The United States of America as represented by the Secretary of the Army, Washington, D.C.

[21] Appl. No.: 265,886

[22] Filed: May 19, 1981

[51] Int. Cl.[3] ..... G08B 29/00; G08B 13/00

[52] U.S. Cl. ..... 340/506; 340/531; 340/550; 340/555; 340/564; 350/96.33; 356/73.1; 356/237; 250/227; 250/572; 455/606; 455/610

[58] Field of Search ..... 340/506, 508, 512, 509–511, 340/525, 531, 533, 537, 541, 550, 555–557, 561–564; 356/73.1, 237; 350/96.33, 96.34, 96.16; 455/610, 606, 601; 250/227, 339, 562, 572

[56] References Cited

U.S. PATENT DOCUMENTS

| | | | |
|---|---|---|---|
| 3,641,549 | 2/1972 | Misek et al. | 340/564 |
| 3,707,709 | 12/1972 | Wolf et al. | 340/564 |
| 3,806,907 | 4/1974 | Bound et al. | 340/564 |
| 3,825,916 | 7/1974 | Steele et al. | 340/564 |
| 3,833,897 | 9/1974 | Bell et al. | 340/564 |
| 3,981,592 | 9/1976 | Williams | 455/601 |
| 4,000,416 | 12/1976 | Goell | 356/96.33 |
| 4,023,154 | 5/1977 | Comeaux | 340/564 |
| 4,070,091 | 1/1978 | Taylor et al. | 350/96.33 |
| 4,144,530 | 3/1979 | Redfern | 340/566 |
| 4,155,083 | 5/1979 | Slaats et al. | 340/564 |
| 4,247,956 | 1/1981 | Christiansen et al. | 455/606 |

*Primary Examiner*—Donnie L. Crosland
*Attorney, Agent, or Firm*—Darrell E. Hollis

[57] ABSTRACT

An improved intrusion detection apparatus for detecting when a fence is cut or has been climbed over, as well as the location of the intrusion. A cable comprising at least one optical fiber having an electrical transmission line running therealong is strung along the fence to be protected. If an intruder either cuts the cable or stresses the fence so that the cable breaks, an optical signal running along the optical fiber or fibers is lost, thus providing an alarm indication at a central station. The loss of the optical signal automatically triggers an electrical pulse generator means which feeds pulses down the transmission line running along the optical fiber. Part of the pulse energy is reflected at the transmission line break, and the time elapsed between transmission and receipt of the pulses is determined by time domain reflectometry techniques (TDR).

5 Claims, 3 Drawing Figures

APPARATUS FOR DETERMINING BREAK LOCATIONS IN FENCING

STATEMENT OF GOVERNMENT INTEREST

The invention described and claimed herein may be manufactured and used by or for the Government of the United States of America for governmental purposes without the payment of royalties thereon or therefor.

FIELD OF THE INVENTION

The present invention is directed to an improved intrusion detection apparatus and particularly to an apparatus for detecting when a fence is cut or has been climbed over, as well as the location of the intrusion.

BACKGROUND OF THE INVENTION

As is known, fencing is frequently used to surround areas which are desired to be kept secure. For example, areas in which secret activities are taking place, warehouses, and prisons, frequently have fencing encircling them to either prevent penetration from the outside in or vice versa. Since the secure area may be very large, and the fencing correspondingly long, it is frequently difficult or impossible for personnel to physically monitor the entire length of it. Thus, it is desirable to provide an apparatus for automatically providing an alarm indication at a central location when the fence has been cut or climbed over, and to further provide an indication of the location of the intrusion so that personnel may be dispersed to the appropriate location to apprehend the intruder.

One intrusion detection apparatus of the prior art utilizes an optical fiber carrying a light signal which is strung around the fence. If the fence is cut or broken, or if it is stressed by someone climbing thereover, the optical fiber breaks with the resultant lost of the transmitted light signal. To locate the break, the fence is divided into sectors or quandrants, each with its own optical fiber, receiver, and transmitter, and signals transmitted in each section or quandrant are coded, with received signals being transmitted to a central monitoring station. Thus, the loss of a particular coded signal at the central station indicates a fence break and identifies the sector or quandrant in which the break or signal loss occurs. While this system is effective to locate fence breaks, it is relatively complicated, as it involves division of the perimeter into sectors and associated coding equipment.

Wolf et al U.S. Pat. No. 3,707,709 provides an intrusion system for detecting an intruder who has cut through or is near a fence wherein a transmission line comprised of the fence and a conductor strung parallel to the fence is utilized. Electrical pulses are fed along the transmission line and are reflected back from the other end of the line, which is open circuited. The reflected, received signal is displayed on an oscilloscope, and if an intruder is near a section of the transmission line or cuts the fence, which forms part of the line, the oscilloscope trace changes. One difficulty with the Wolf et al system is that it requires constant monitoring of the oscilloscope, as it does not provide an alarm signal to alert personnel to the occurence of an intrusion.

Comeaux U.S. Pat. No. 4,023,154 and Redfern U.S. Pat. No. 4,144,530 are also directed to fence intrusion detection systems, but also suffer from certain disadvantages.

BRIEF SUMMARY OF THE INVENTION

It is thus an object of the present invention to provide an improved fence intrusion detection apparatus.

It is a further object of the invention to provide a fence intrusion detection apparatus which provides an indication of the location of the intrusion with relatively high accuracy.

It is a further object of the invention to provide a fence intrusion detection apparatus which both provides an alarm signal to alert control personnel, and then provides an indication of the location of the intrusion.

It is a further object of the invention to provide a fence intrusion detection apparatus which uses relatively few components, and is relatively inexpensive to make.

In accordance with the invention, a cable comprising at least one optical fiber having an electrical transmission line running therealong is strung along the fence to be protected. If an intruder either cuts the cable or stresses the fence so that the cable breaks, an optical signal running along the optical fiber or fibers is lost, thus providing an alarm indication at a central station. Further, the loss of the optical signal automatically triggers an electrical pulse generator means which feeds pulses down the transmission line which runs along the optical fiber. Part of the pulse energy is reflected at the transmission line break, and an indicator means is provided for indicating the time elapsed between transmission of the pulses and receipt of the reflected pulses, which provides an indication of the break location.

In one embodiment of the invention, two optical fibers are provided, each being coated with a conductive or metallized coating, and the transmission line is comprised of the two conductors formed by the fiber coatings. In another embodiment, a single optical fiber is used in a concentric structure wherein two conducting layers separated by an insulating layer cover the fiber, the two conducting layers forming the transmission line.

BRIEF DESCRIPTION OF THE DRAWINGS

The invention will be better understood by referring to the accompanying drawings in which.

DETAILED DESCRIPTION OF EMBODIMENTS

Figure 1:
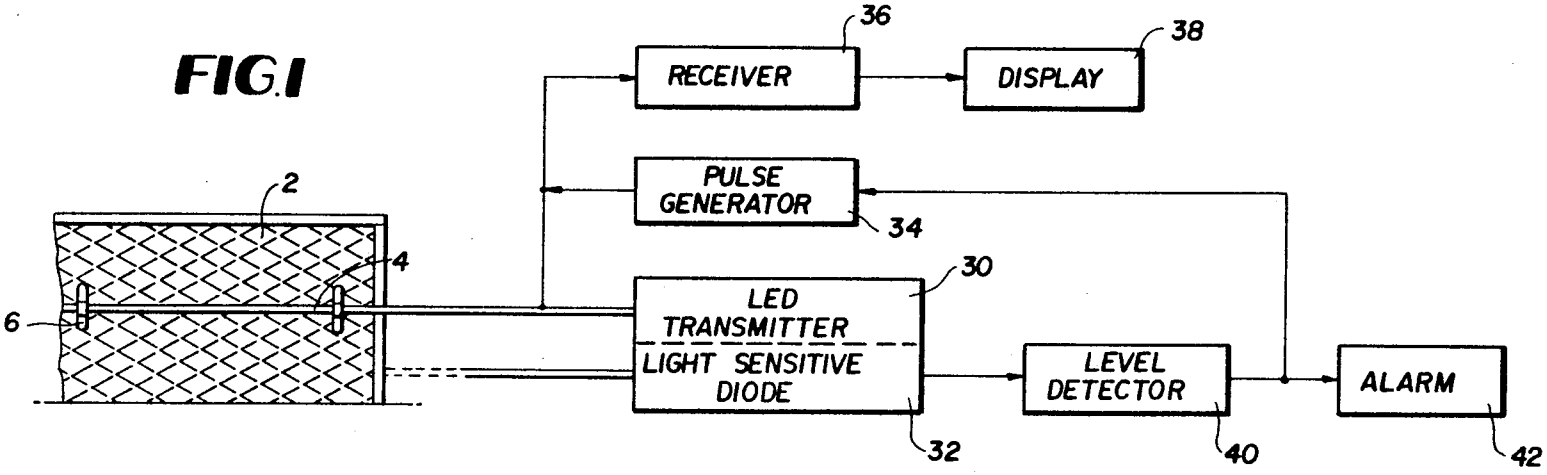
FIG. 1 is a pictorial illustration of the apparatus of the present invention.

Referring to FIG. 1, fence portion 2 is a portion of the fence which is to be monitored by the apparatus of the invention. Cable 4 is strung along the fence, and is supported either by conventional support means 6 or by being interwoven with the fence links, and extends around the entire fence, or at least around the portion which is to be monitored.

Cable 4 is comprised of at least an optical fiber having an electrical transmission line running therealong. For example, as mentioned above, one embodiment of the cable is shown in FIG. 2, and is seen to be comprised of a pair of optical fibers 8 and 10, being coated with respective conductive or metallized coatings 12 and 14.

The coated fibers are separated from each other by insulating material 16 is which they may be embedded. The pair of conductive coatings 12, 14 form the electrical transmission line.

Figure 3:
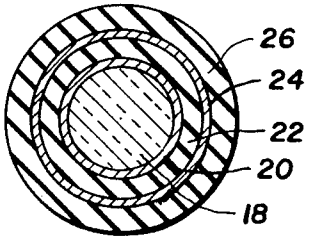
FIG. 3 is a cross-sectional view of a further embodiment of cable 4 of FIG. 1.

In the embodiment of FIG. 3, a single optical fiber 18 is utilized and is coated with conductive coating 20 which is in turn covered with insulating material 22, which is itself coated with conductive coating 24 which again may be covered with insulating material 26. Thus, a concentric structure is provided, and the transmission line is comprised of coaxial conductors 20 and 24. In a still further embodiment of the cable, a pair of thin wires may comprise the transmission line and may be run along an optical fiber. In a still further embodiment, the outer insulator 26 in FIG. 3 may be eliminated and an additional zinc (or other) coating may be applied over 24 so that the composite resembles any other wire in the fence.

Figure 2:
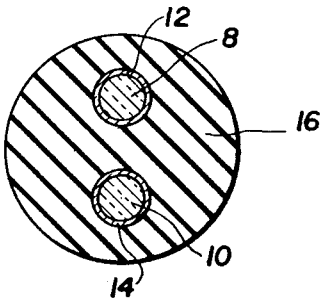
FIG. 2 is a cross-sectional view of an embodiment of cable 4 in FIG. 1.

Referring to FIG. 1, one end of the optical fiber or of both optical fibers in the case of the embodiment of FIG. 2 is connected to a light transmitter such as an LED or laser transmitter 30 while the other end of the fiber or fibers is connected to a light receiver 32 such as light sensitive diode, after having been strung around the fence. One end of the transmission line is connected to pulse generator 34 and the same end is connected to pulse receiver 36, the output of which is connected to display means 38. The other end of the transmission line is left open circuited.

The output of light receiver 32 is connected to level detector 40, which for instance may be a Schmitt trigger, and the output of the level detector is connected to an alarm means 42 such as a bell or buzzer, and also to pulse generator 34.

In the operation of the apparatus, LED transmitter 30 is turned on to feed an optical signal along the fiber, which is received by light sensitive diode receiver 32. When the optical fiber or fibers is broken by an intruder, the optical signal is interrupted and level detector 40 which is connected to the output of the light receiver emits an output signal which causes alarm means 42 which as mentioned above is preferably an audible alarm, to emit and alarm signal. Further, the output of level detector 40 is connected to the input of electrical pulse generator 34, and when an alarm is detected, causes the pulse generator to turn on. Thus, a train of pulses is fed to the transmission line, and part of the pulse energy is reflected back at the break in the line. Thus, the time elapsed between pulse transmission and reception is indicative of the location of the break. Such elapsed time may be displayed on display means 38 which may be an oscilloscope, or may merely be a display indicating time, whereupon break location may be correlated with elapsed time by control personnel. The readout may also be calibrated directly in units of distance to the detected break. The elapsed time is determined by time domain reflectometry (TDR) techniques. One system for making such a determination is disclosed in Wolf et al U.S. Pat. No. 3,707,709 which is incorporated herein by reference. Of course, other specific techniques for measuring the elapsed time may be utilized and are intended to be covered by the present invention.

Thus, upon being alerted by alarm means 42, control personnel would consult display means 38 to determine the location of the intrusion. Thereupon, security personnel would be instructed to proceed to the indicated location to apprehend the intruder.

Further, it should be understood that while I have described certain embodiments of the invention, I do not intend to be restricted thereto, but rather intend to cover all variations and modifications which come within the spirit of the invention, which is limited only by the claims which are appended hereto.

We claim:

1. An apparatus for intrusion detection, comprising, a cable comprising at least one optical fiber having an electrical transmission line running therealong, means for generating light energy into one end of said at least one optical fiber, means for receiving said light energy at the other end of said at least one optical fiber, electrical pulse generator means, responsive to said light energy receiving means, for transmitting electrical pulses into one end of said transmission line, when said optical fiber is broken, electrical pulse receiver means for receiving said electrical pulses at the same end of said transmission line that said pulses are transmitted into, and indicator means, responsive to said electrical pulse receiver means and said electrical pulse generator means, for indicating the time difference between the time said pulses are transmitted and the time they are received.

2. The apparatus of claim 1 further including means responsive to said received light energy falling below a predetermined value for automatically providing an alarm signal and turning said pulse generator means on, whereby a break in said optical fiber causes said pulse generator means to automatically turn on and said indicator means to provide an indication of the location of the intrusion.

3. The apparatus of claim 2, wherein said at least one optical fiber comprises two optical fibers, each having a conductive or metallized coating around the exterior thereof, and said transmission line comprises the pair of conductors formed by said conductive or metallized coatings.

4. The apparatus of claim 3, wherein said two optical fibers are spaced and electrically insulated from each other.

5. The apparatus of claim 2, wherein said at least one optical fiber comprises a fiber having a conductive coating therearound, a first insulating coating being disposed around said conductive coating, a second conductive coating being disposed around said first insulating coating, and a second insulating coating being disposed around said second conductive coating, wherein said transmission line comprises the conductors formed by said conductive coating and said second conductive coating.

* * * * *